US008218808B2

(12) United States Patent
Xu

(10) Patent No.: US 8,218,808 B2
(45) Date of Patent: Jul. 10, 2012

(54) EARPHONE CAPABLE OF ADAPTING TO DIFFERENT AUDIO OUTPUT SOCKETS

(75) Inventor: Bao-Qin Xu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 289 days.

(21) Appl. No.: 12/650,418

(22) Filed: Dec. 30, 2009

(65) Prior Publication Data

US 2010/0177924 A1 Jul. 15, 2010

(30) Foreign Application Priority Data

Jan. 15, 2009 (CN) ..... 2009 1 0300198

(51) Int. Cl.
*H04R 25/00* (2006.01)

(52) U.S. Cl. ..... 381/384; 381/370

(58) Field of Classification Search ..... 381/370, 381/384
See application file for complete search history.

(56) References Cited

U.S. PATENT DOCUMENTS

2005/0036644 A1* 2/2005 Yang ..... 381/384
2005/0215111 A1* 9/2005 Weikel et al. ..... 439/502

* cited by examiner

*Primary Examiner* — Davetta W Goins
*Assistant Examiner* — Matthew Eason
(74) *Attorney, Agent, or Firm* — Altis Law Group, Inc.

(57) ABSTRACT

An earphone is configured to be coupled to a first audio output socket or a second audio output socket. The earphone includes a main body and a plug module. The main body includes a sleeve adapter, an earpiece, and a cable electrically connecting the sleeve adapter and the earpiece. The plug module includes a first end and a second end which are electrically connected to each other. The first end and the second end are of different diameters. In a first mode, the first end is plugged into the sleeve adapter, and the second end is capable of being coupled to the second audio output socket. In a second mode, the second end is plugged into the sleeve adapter, and the first end is capable of being coupled to the first audio output socket.

18 Claims, 6 Drawing Sheets

EARPHONE CAPABLE OF ADAPTING TO DIFFERENT AUDIO OUTPUT SOCKETS

BACKGROUND

1. Technical Field

The present disclosure relates to earphones, and particularly to an earphone having a detachable plug.

2. Description of Related Art

Most current media players such as MPEG Audio Layer 3 (MP3) players are equipped with a 3.5 mm audio output socket, while some other media players such as some mobile phones are equipped with a 2.5 mm audio output socket. An earphone for a media player with a 2.5 mm audio output socket cannot be used with a media player having a 3.5 mm audio output socket. As a result, someone having both a media player with a 2.5 mm audio output socket and a media player with a 3.5 mm audio output socket has to buy two different earphones for the two media players. This may be an inconvenience and costly.

Therefore, it is desirable to provide an earphone capable of adapting to different audio output sockets which can overcome the above-mentioned problems.

BRIEF DESCRIPTION OF THE DRAWINGS

The components of the drawings are not necessarily drawn to scale, the emphasis instead being placed upon clearly illustrating the principles of the embodiments of an earphone. Moreover, in the drawings, like reference numerals designate corresponding parts throughout several views.

DETAILED DESCRIPTION

Embodiments of the present disclosure will now be described in detail with reference to the drawings.

Figure 1:
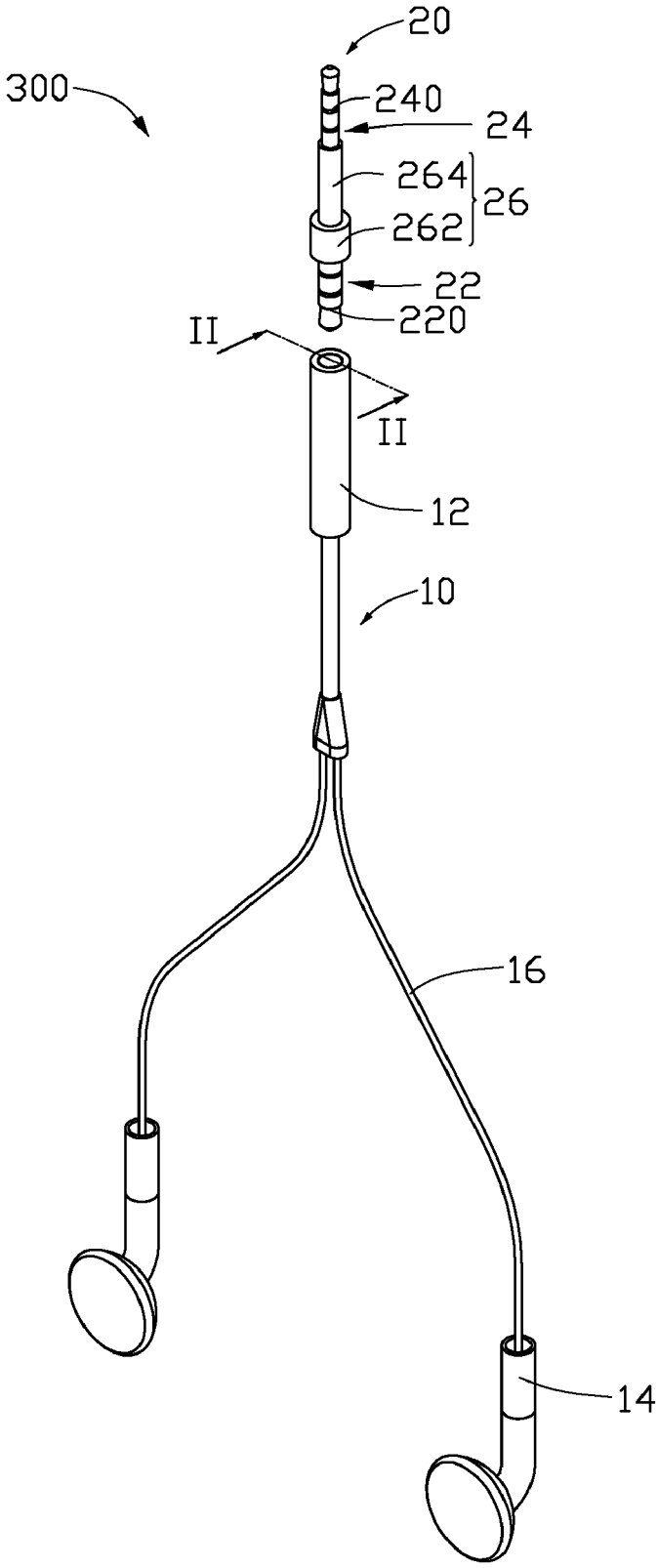
FIG. 1 is an exploded view of an earphone in accordance with an exemplary embodiment.

Referring to FIG. 1, an earphone 300 includes, according to an exemplary embodiment, a main body 10 and a plug module 20 detachably connected to the main body 10. The earphone 300 is configured to be connected to an electronic device (not shown) to receive audio signals from the electronic device. The electronic device includes an audio output socket to output the audio signals, and the plug module 20 is configured to be coupled with the audio output socket to receive the audio signals.

The plug module 20 includes a first end 22, a second end 24, and a connecting member 26 disposed between and interconnecting the first end 22 and the second end 24. The first end 22 includes a number of first receiving pads 220 for receiving electrical signals from the output socket. The second end 24 includes a number of second receiving pads 240 for receiving electrical signals from the output socket. The second receiving pads 240 are electrically connected to the first receiving pads 220 respectively via wires 221 (see FIG. 4). In this embodiment, the first end 22 is a 3.5 mm stereo plug, and the second end 24 is a 2.5 mm stereo plug.

The connecting member 26 is electrically insulative, and includes an extension 262 and a flange 264 connected to the extension 262. The extension 262 is connected to the first end 22. The flange 264 is connected to the second end 24. In this embodiment, the extension 262 and the flange 264 are cylindrical and concentric to each other, such that the first end 22 and the second end 24 are coaxial to each other. A diameter of the extension 262 is greater than that of the flange 264. A diameter and a length of the flange 264 are substantially equal to that of the first end 22.

The main body 10 includes a sleeve adapter 12, two earpieces 14, and two cables 16 connecting the sleeve adapter 12 to the two earpieces 14 respectively. In other embodiments, the main body 10 may include one earpiece 14 and one cable 16.

Figure 2:
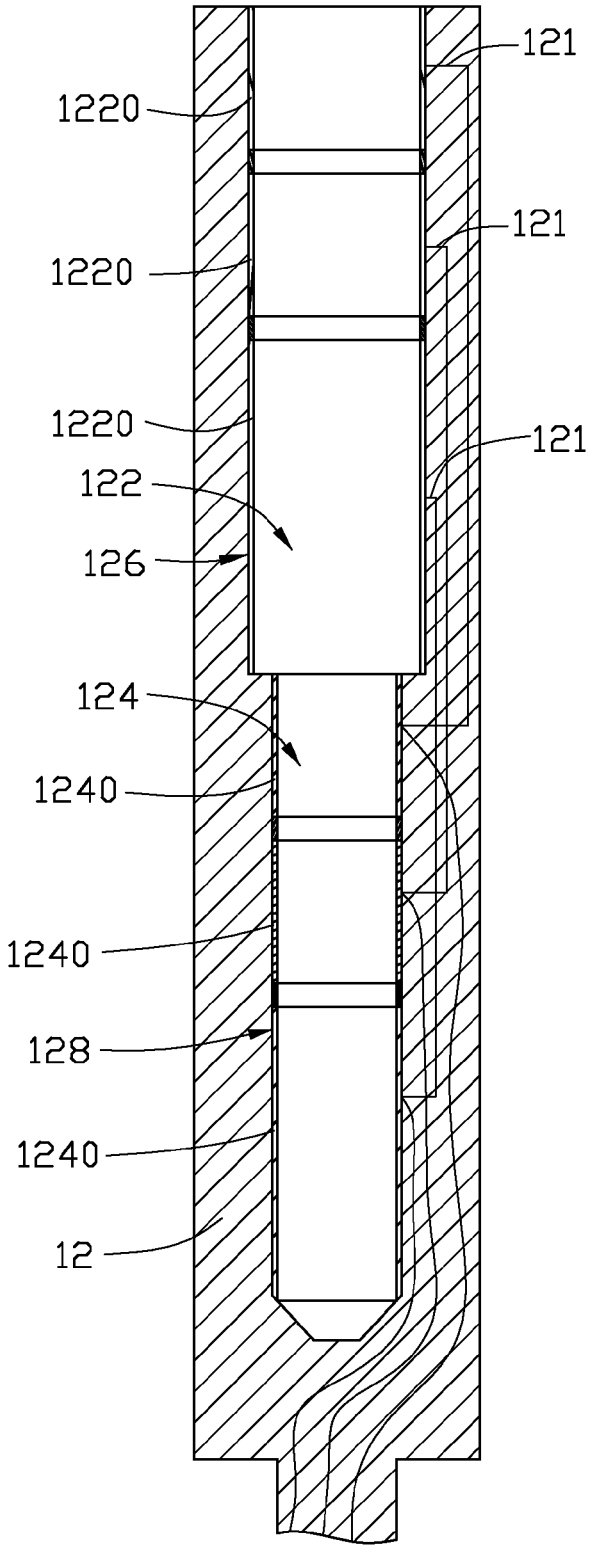
FIG. 2 is a cross-sectional view taken along line II-II of FIG. 1.

Referring to FIG. 2, the sleeve adapter 12 is cylindrical and defines a first hole 122 and a second hole 124. The sleeve adapter 12 forms a first inner surface 126 and a second inner surface 128 that bound the first hole 122 and the second hole 124 respectively. The first hole 122 communicates with the second hole 124. The first hole 122 is configured to receive the first end 22 or the flange 264 of the connecting member 26. The second hole 124 is configured to receive the second end 24. The length of the first hole 122 and the length of the second hole 124 are substantially equal to the lengths of the first end 22 and the second end 24 respectively. The inner diameter of the first hole 122 and the inner diameter of the second hole 124 are substantially equal to the diameters of the first end 22 and the second end 24 respectively, such that the first end 22 and the second end 24 can be tightly inserted into the sleeve adapter 12, and a reliable electrical connection can be established for transmitting audio signals.

The sleeve adapter 12 further includes a number of first connecting pads 1220 and a number of second connecting pads 1240. The first connecting pads 1220 are disposed separately on the first inner surface 126 to contact the first receiving pads 220 respectively. The second connecting pads 1240 are disposed separately on the second inner surface 128 to contact the second receiving pads 240 respectively. The first connecting pads 1220 are electrically connected to the second connecting pads 1240 respectively via wires 121. The second connecting pads 1240 are further electrically connected to the two earpieces 14 respectively via the two cables 16.

Figure 3:
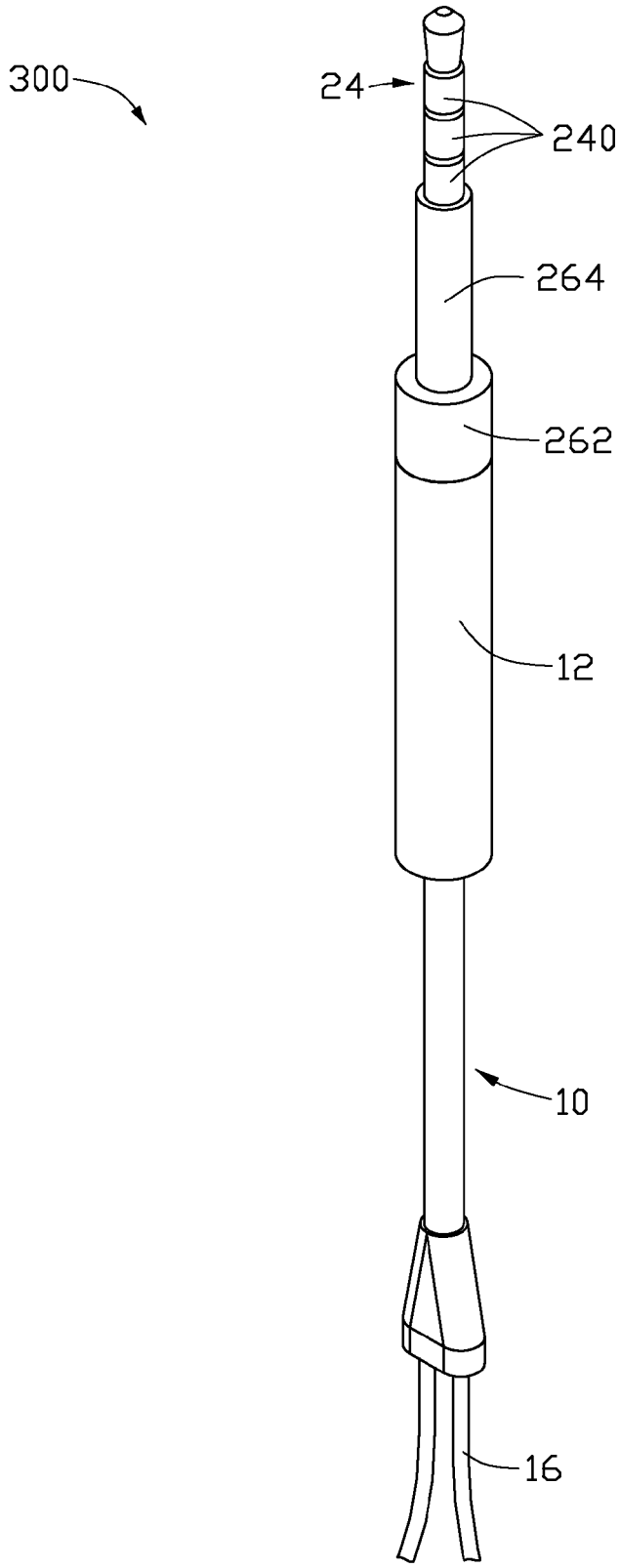
FIG. 3 is an assembled view of the earphone of FIG. 1 in a first mode.
Figure 4:
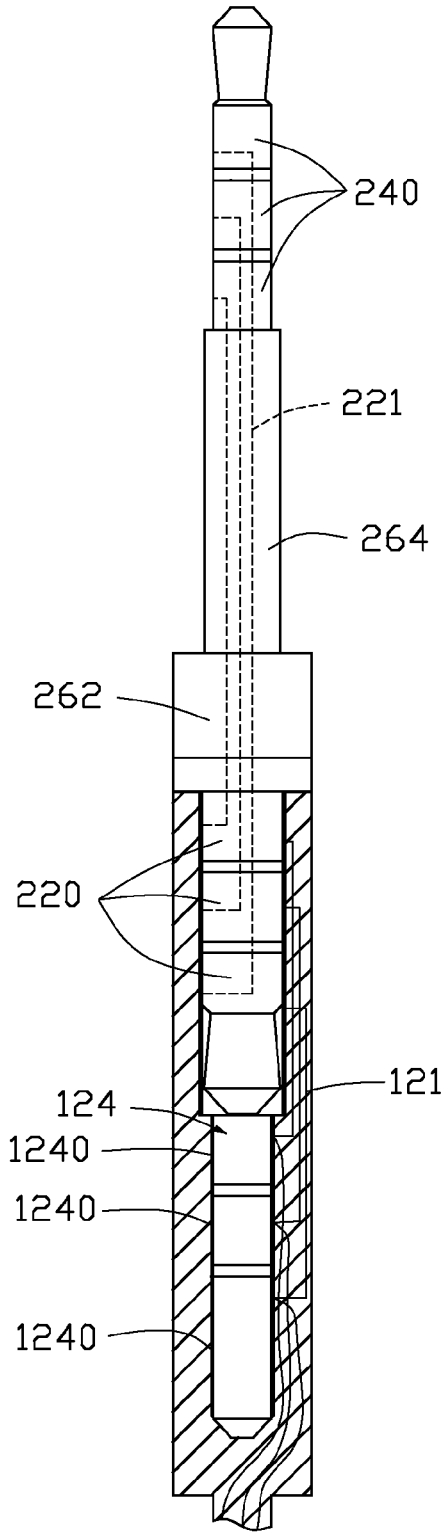
FIG. 4 is a partially cross-sectional view of the earphone of FIG. 3.

Referring to FIGS. 3 and 4, in a first mode, the first end 22 is inserted into the first hole 122. The first end 22 is tightly confined in the first inner surface 126 so as to prevent the plug module 20 from falling out the sleeve adapter 12. The first receiving pads 220 are electrically connected with the first connecting pads 1220 respectively. The audio signals are transmitted through the second end 24, the first end 22, the sleeve adapter 12, and the cables 16, and finally to the two earpieces 14.

Figure 5:
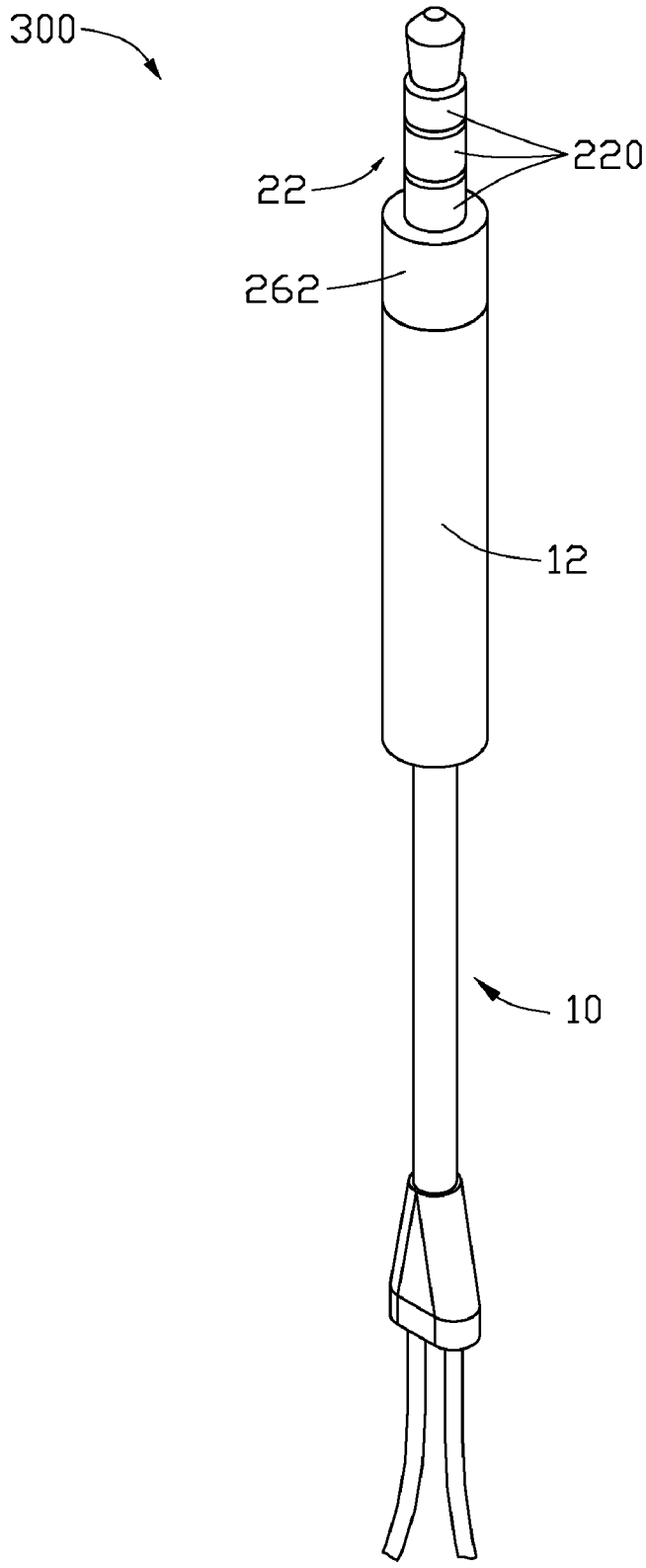
FIG. 5 is an assembled view of the earphone of FIG. 1 in a second mode.
Figure 6:
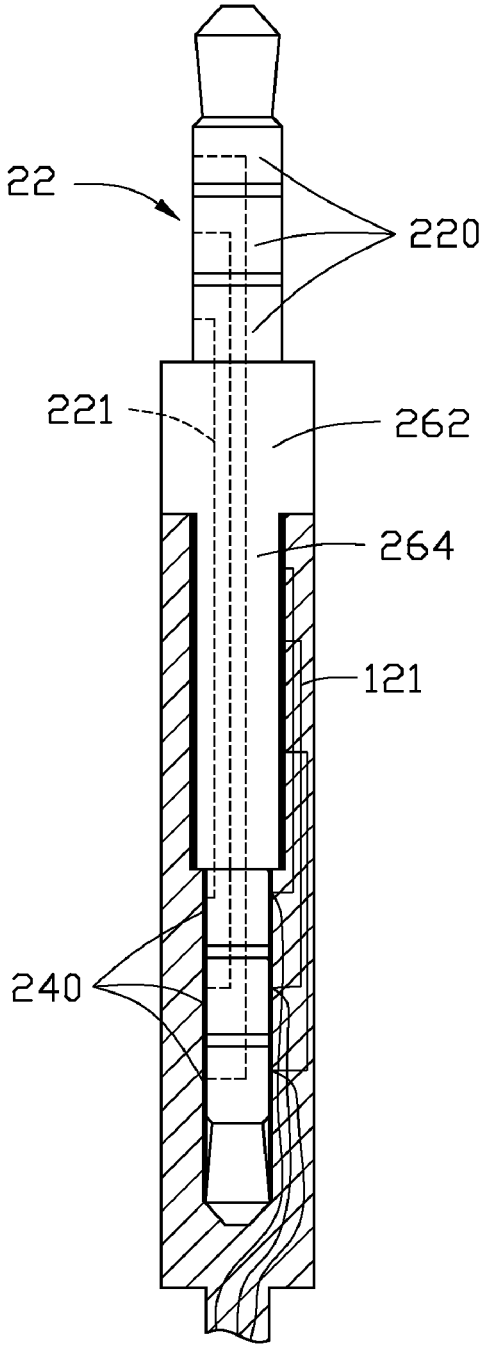
FIG. 6 is a partially cross-sectional view of the earphone of FIG. 5.

Referring to FIGS. 5 and 6, in a second mode, the second end 24 is inserted into the sleeve adapter 12 and received in the second hole 124, and the flange 264 is tightly received in the first hole 122. The second receiving pads 240 are electrically connected to the second connecting pads 1240 respectively. The audio signals are transmitted through the first end 22, the second end 24, the sleeve adapter 12, and the cables 16, and finally to the two earpieces 14.

Thus, the earphone 300 has a beneficial of capable of adapting different electronic devices having different audio output sockets.

While various exemplary and preferred embodiments have been described, it is to be understood that the disclosure is not limited thereto. To the contrary, various modifications and similar arrangements (as would be apparent to those skilled in the art) are intended to also be covered. Therefore, the scope of the appended claims should be accorded the broadest interpretation so as to encompass all such modifications and similar arrangements.

What is claimed is:

1. An earphone configured for being coupled to a first audio output socket or a second audio output socket, the earphone comprising:

a main body comprising:

a sleeve adapter;

at least one earpiece; and at least one cable configured for electrically connecting the sleeve adapter to the at least one earpiece correspondingly; and a plug module detachably connected to the main body, the plug module comprising a first end and a second end which are electrically connected to each other, a diameter of the first end being different from that of the second end;

wherein in a first mode the first end is plugged into the sleeve adapter and electrically connected to the sleeve adapter, and the second end is capable of being coupled to the second audio output socket; and wherein in a second mode the second end is plugged into the sleeve adapter and electrically connected to the sleeve adapter, and the first end is capable of being coupled to the first audio output socket.

2. The earphone of claim 1, wherein the sleeve adapter defines a first hole to receive the first end and a second hole to receive the second end.

3. The earphone of claim 2, wherein the plug module further comprises a connecting member interconnecting the first end and the second end.

4. The earphone of claim 3, wherein the first end and the second end are disposed on two opposite ends of the connecting member.

5. The earphone of claim 3, wherein the first hole communicates with the second hole, the connecting member comprises an extension and a flange, the extension is connected to the first end, the flange is connected to the second end, the flange is configured to be inserted into the first hole when the second end is inserted into the second hole in the second mode.

6. The earphone of claim 2, wherein the sleeve adapter comprises a plurality of first connecting pads and a plurality of second connecting pads, the plurality of the first connecting pads are separately disposed on a first inner surface of the sleeve adapter bounding the first hole, the plurality of the second connecting pads are separately disposed on a second inner surface of the sleeve adapter bounding the second hole, the plurality of the first connecting pads and the plurality of the second connecting pads are electrically connected to the at least one earpiece, the plurality of the first connecting pads are electrically connected to the first end in the first mode, the plurality of the second connecting pads are electrically connected to the second end in the second mode.

7. The earphone of claim 6, wherein the plurality of the first connecting pads are electrically connected to the plurality of the second connecting pads correspondingly.

8. The earphone of claim 1, wherein the first end comprises a plurality of first receiving pads for receiving audio signals from the first audio output socket, the second end comprises a plurality of second receiving pads for receiving audio signals from the second audio output socket, the plurality of the first receiving pads are electrically connected to the plurality of the second receiving pads correspondingly.

9. The earphone of claim 1, wherein the first end is 3.5 mm stereo plug, the second end is 2.5 mm stereo plug.

10. An earphone configured for receiving audio signals from a first audio output socket or a second audio output socket, the earphone comprising:

a main body comprising:

a sleeve adapter;

at least one earpiece; and at least one cable configured for electrically connecting the sleeve adapter to the at least one earpiece correspondingly; and a plug module connected to the main body, the plug module comprising a first end and a second end with different physical configuration;

wherein the earphone is capable of being switched between a first mode and a second mode, in the first mode, the first end is plugged into the sleeve adapter and electrically connected to the sleeve adapter and the second end is exposed from the sleeve adapter to be coupled to the second audio output socket, the second end is capable of being operated to establish a first electrical connection for transmitting audio signals from the second audio output socket to the at least one earpiece via the sleeve adapter and the at least one cable; and wherein in the second mode, the second end is plugged into the sleeve adapter and electrically connected to the sleeve adapter, and the first end is exposed from the sleeve adapter to be coupled to the first audio output socket, the first end is capable of being operated to establish a second electrical connection for transmitting audio signals from the first audio output socket to the at least one earpiece via the sleeve adapter and the at least one cable.

11. The earphone of claim 10, wherein a radial length of the first end is different from that of the second end.

12. The earphone of claim 10, wherein the first end comprises a plurality of first receiving pads for receiving audio signals from the first audio output socket, the second end comprises a plurality of second receiving pads for receiving audio signals from the second audio output socket, the plurality of the first receiving pads are electrically connected to the plurality of the second receiving pads correspondingly.

13. The earphone of claim 10, wherein the sleeve adapter defines a first hole to receive the first end and a second hole to receive the second end.

14. The earphone of claim 13, wherein the plug module further comprises a connecting member connecting the first end and the second end.

15. The earphone of claim 14, wherein the first hole communicates with the second hole, the connecting member comprises an extension and a flange, the extension is connected to the first end, the flange is connected to the second end, the flange is configured to be inserted into the first hole when the second end is inserted into the second hole.

16. The earphone of claim 14, wherein the sleeve adapter comprises a plurality of first connecting pads and a plurality of second connecting pads, the plurality of the first connecting pads are separately disposed on a first inner surface of the sleeve adapter bounding the first hole, the plurality of the second connecting pads are separately disposed on a second inner surface of the sleeve adapter bounding the second hole, the plurality of the first connecting pads and the plurality of the second connecting pads are electrically connected to the at least one earpiece, the plurality of the first connecting pads are electrically connected to the first end in a first mode, the plurality of the second connecting pads are electrically connected to the second end in a second mode.

17. The earphone of claim 16, wherein the plurality of the first connecting pads are electrically connected to the plurality of the second connecting pads correspondingly.

18. The earphone of claim 10, wherein the first end is 3.5 mm stereo plug, the second end is 2.5 mm stereo plug.

* * * * *